US007327967B2

(12) United States Patent
Mori et al.

(10) Patent No.: US 7,327,967 B2
(45) Date of Patent: Feb. 5, 2008

(54) IMAGE HEATING APPARATUS WITH VARIABLE TIMING

(75) Inventors: Akihito Mori, Toride (JP); Nobuo Sekiguchi, Moriya (JP); Keita Takahashi, Abiko (JP); Tadaaki Saida, Kashiwa (JP); Takashi Nagaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 11/245,245

(22) Filed: Oct. 7, 2005

(65) Prior Publication Data

US 2006/0083528 A1 Apr. 20, 2006

(30) Foreign Application Priority Data

Oct. 20, 2004 (JP) ..... 2004-305732

(51) Int. Cl.
*G03G 15/20* (2006.01)

(52) U.S. Cl. ..... 399/67; 399/68; 399/322; 399/328; 399/329

(58) Field of Classification Search ..... 219/216; 399/67, 68, 69, 70, 322, 328, 329
See application file for complete search history.

(56) References Cited

U.S. PATENT DOCUMENTS

| | | | | |
|---|---|---|---|---|
| 5,111,249 | A | 5/1992 | Owada | 355/285 |
| 6,674,978 | B1 | 1/2004 | Suzuki et al. | 399/67 |
| 2006/0083528 | A1 | 4/2006 | Mori et al. | 399/67 |

FOREIGN PATENT DOCUMENTS

| | | |
|---|---|---|
| JP | 1-194647 | 4/1989 |
| JP | 11-2979 | 1/1999 |
| JP | 11-194647 | 7/1999 |
| JP | 11-231701 | 8/1999 |
| JP | 2004-20641 | 1/2004 |
| JP | 2004-69968 | 3/2004 |

*Primary Examiner*—Hoang Ngo
(74) *Attorney, Agent, or Firm*—Fitzpatrick, Cella, Harper & Scinto

(57) ABSTRACT

In a construction wherein at the start of fixing, a pressure belt is brought into contact with a fixing roller at uniform timing, it has sometimes been the case that the temperature of the pressure belt at a point of time whereat the fixing is started does not become a desired temperature but faulty fixing occurs. The timing for bringing the pressure belt into contact with the fixing roller at the start of fixing is changed in accordance with the detected temperature of the pressure belt. By such a construction, faulty fixing can be prevented from occurring.

12 Claims, 10 Drawing Sheets

IMAGE HEATING APPARATUS WITH VARIABLE TIMING

BACKGROUND OF THE INVENTION

1. Field of the Invention

The invention relates to an image heating apparatus for heating an image formed on a recording material. As such image heating apparatus, mention can be made, for example, of a fixing apparatus which heat-fixes a toner image on a recording material formed by the use of an electrophotographic printing method or an electrostatic recording method.

2. Related Background Art

There has heretofore been devised and put into practical use an apparatus for heating and fixing a toner image in a powder material form formed of heat-fusible resin by image forming process means as a fixed image on a recording material by a fixing apparatus.

As a fixing apparatus for heating and fusing a toner image to thereby fix it on a recording material, there is known one using a fixing roller and a pressure roller, or one using a fixing roller and a pressure belt.

In such a fixing apparatus constituted by a fixing roller and a pressure belt, it has been proposed to make the pressure belt movable toward and away from the fixing roller so as to keep the pressure belt spaced apart from the fixing roller except during sheet supply (see Japanese Patent Application Laid-open No. H11-231701). This is for preventing an inconvenience caused by vapor in paper having its surface coated with resin or the like, i.e., so-called coat paper, breaking through a coat layer and diffusing when the coat paper is subjected to a fixing process. In this apparatus, the controlled temperature of the pressure belt is made lower than the controlled temperature of the fixing roller.

So, in the above-described fixing apparatus, immediately before a recording material dashes into a nip portion, the pressure belt is brought into contact with the fixing roller to thereby decrease an amount of heat given from the pressure belt side to the recording material (unfixed image) (provide a predetermined or greater temperature difference between the fixing roller and the pressure belt), thus preventing the above-noted inconvenience.

In the above-described fixing apparatus, however, there is adopted a construction in which the pressure belt is brought into contact with the fixing roller at uniform timing immediately before the recording material dashes into the nip portion. That is, the time from a point of time at which the pressure belt has been brought into contact with the fixing roller until a point of time at which the recording material dashes into the fixing nip is uniformly determined. Therefore, the following problem has arisen in a case where after the fixing process has been continuously carried out in an image forming job of continuously effecting image formation on a plurality of recording materials, the next image forming job is immediately demanded.

In a case where the fixing apparatus is operated at the start of that next image forming job, if the temperature of the pressure belt at that point of time is low, the pressure belt has sometimes not come to rise to a predetermined temperature before the recording material dashes into the nip portion, and the amount of heat given to the recording material (image) has become deficient, thus causing faulty fixing. On the other hand, if the temperature of the pressure belt at that point of time is high, the temperature of the pressure belt will become nearly equal to the temperature of the fixing roller and the amount of heat given to the recording material (image) will become excessive. As a result, thus has sometimes been caused the occurrence of a faulty image by high temperature offset or the above-described vapor diffusion (in the case of the coat paper), or the faulty fixing that the recording material is not separated from the pressure belt.

SUMMARY OF THE INVENTION

It is an object of the present invention to provide an image heating apparatus which can suppress faulty image heating.

It is also an object of the present invention to provide an image heating apparatus having a heat rotary member for heating an image formed on a recording material in a nip portion, a pressure rotary member forming the nip portion between itself and the heat rotary member, means for bringing the pressure rotary member into contact with the heat rotary member at the start of an image heating process, and changing means for changing the time from after the pressure rotary member has been brought into contact with the heat rotary member until the recording material arrives at the nip portion.

Further objects of the present invention will become apparent from the following detailed description when read with reference to the accompanying drawings.

DESCRIPTION OF THE PREFERRED EMBODIMENTS

An embodiment of the present invention will hereinafter be described. The present invention is not restricted to the embodiment hereinafter described, but can be changed to various known constructions within the scope of the technical idea of the present invention.

Embodiment

An image forming apparatus according to the present invention will hereinafter be described in greater detail.

<General Construction of the Image Forming Apparatus>

Figure 11:
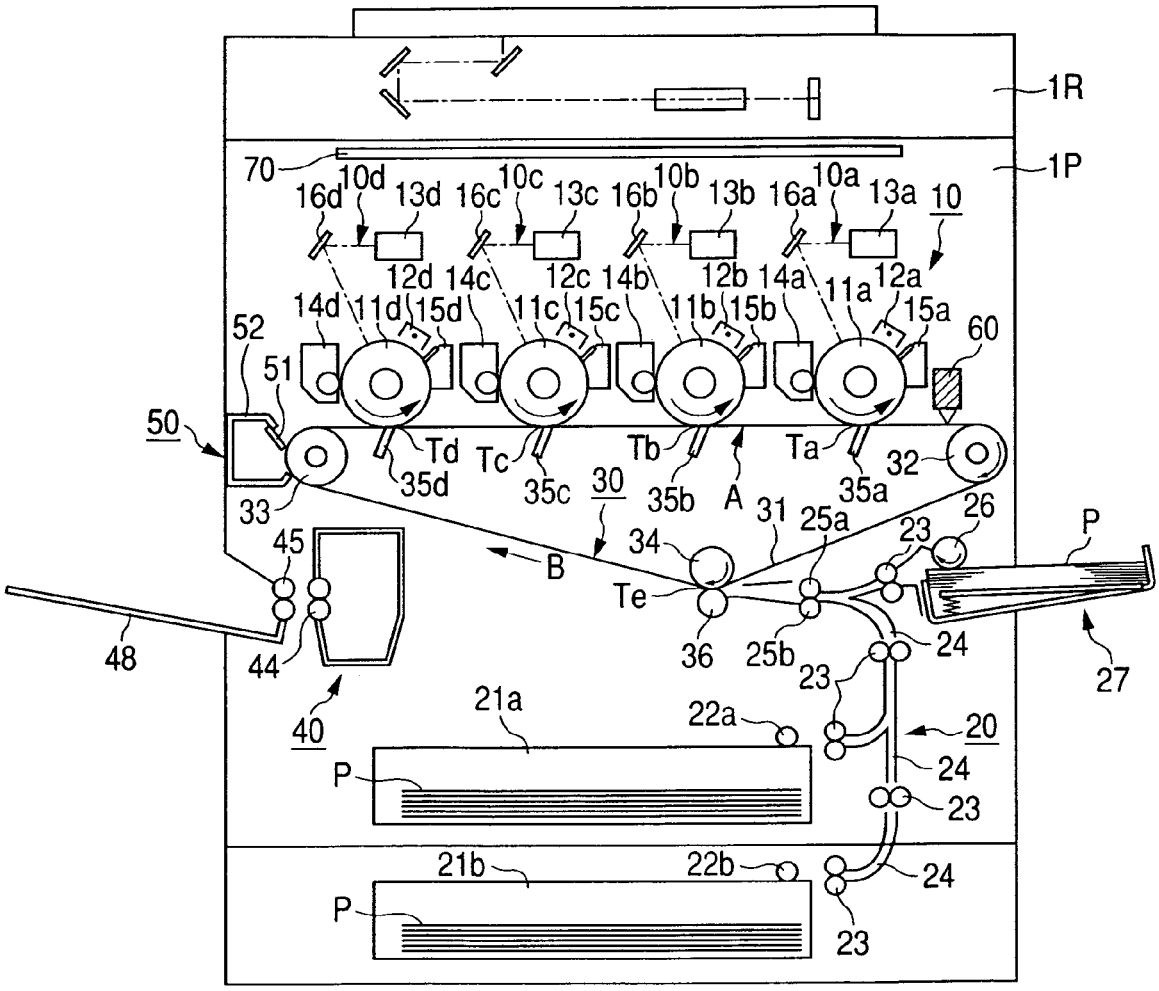
FIG. 11 is a cross-sectional view of a copying machine provided with a fixing apparatus.

FIG. 11 is a cross-sectional view of the essential portions of an image forming apparatus to which the present invention can be applied. In the present embodiment, a copying machine adopting an electrophotographic printing method will be described as an example.

An image heating apparatus according to the present invention is applicable not only to such a fixing apparatus for fixing an unfixed toner image on a recording material such as will be described later, but also to a gloss increasing apparatus for increasing the gloss of an image by re-heating a toner image already fixed on a recording material.

An image outputting portion IP is broadly comprised of an image forming portion 10 (in which four stations 10*a*, 10*b*, 10*c* and 10*d* of the same construction are juxtaposed), a sheet supplying unit 20, an intermediate transfer unit 30, a fixing unit 40 and a controlling portion 80 (not shown in FIG. 11).

The individual units will be further described in detail. The image forming portion 10 is of such a construction as will be described below. Photosensitive drums 11*a*, 11*b*, 11*c* and 11*d* as image bearing members are journalled at the respective centers thereof, and are rotatively driven in the direction indicated by the arrow. Primary chargers 12*a*, 12*b*, 12*c*, 12*d*, the exposing portions 13*a*, 13*b*, 13*c*, 13*d* of an optical system which is an exposing portion, turn-back mirrors 16*a*, 16*b*, 16*c*, 16*d* and developing apparatuses 14*a*, 14*b*, 14*c*, 14*d* are disposed in opposed relationship with the outer peripheral surfaces of the photosensitive drums 11*a*-11*d* and in the rotation directions thereof.

By the primary chargers 12*a*-12*d*, uniform amounts of charges are given to the surfaces of the photosensitive drums 11*a*-1*d*. Then, by the exposing portions 13*a*-13*d*, the photosensitive drums 11*a*-11*d* are exposed to a ray of light such as, for example, a laser beam modulated according to a recording image signal, by the exposing portions 13*a*-13*d* through the intermediary of the turn-back mirrors 16*a*-16*d*, whereby electrostatic latent images are formed thereon.

Further, the electrostatic latent images are visualized by the developing apparatuses 14*a*-14*d* containing therein developers (hereinafter referred to as the "toners") of four colors, i.e., yellow, cyan, magenta and black. The visualized visible images (developed images) are transferred to the image transfer areas Ta, Tb, Tc and Td of an intermediate transfer belt 31 which is an intermediate transfer member.

At downstream points whereat the photosensitive drums 11*a*-11*d* have been rotated past the image transfer areas Ta-Td, any toners not transferred to the intermediate transfer belt 31 but residual on the photosensitive drums 11*a*-11*d* are scraped off by cleaning apparatuses 15*a*, 15*b*, 15*c* and 15*d* to thereby effect the cleaning of the surfaces of the drums. By the process shown above, image formation by the respective toners is sequentially effected.

The sheet supplying unit 20 is comprised of cassettes 21*a*, 21*b* and a manually feeding tray 27 for containing therein recording materials P as recording materials, pickup rollers 22*a*, 22*b*, 26 for feeding the recording materials P one by one from the cassettes 21*a*, 21*b* or the manually feeding tray 27, a pair of sheet feeding rollers 23 and a sheet feeding guide 24 for conveying the recording materials P fed out from the respective pickup rollers 22*a*, 22*b*, 26 to registration rollers 25*a*, 25*b*, and the registration rollers 25*a*, 25*b* for feeding out the recording materials P to a secondary transfer area Te in timed relationship with the image formation by the image forming portion.

The intermediate transfer unit 30 will now be described in detail. The intermediate transfer belt 31 is stretched around a drive roller 32 for transmitting a drive to the intermediate transfer belt 31, a driven roller 33 driven to rotate by the rotation of the intermediate transfer belt 31, and a secondary transfer opposed roller 34 opposed to the secondary transfer area Te with the belt 31 interposed therebetween. A primary transfer plane A is formed between the driven roller 32 and the driven roller 33. The drive roller 32 comprises a metallic roller having its surface coated with rubber (urethane or chloroprene) having a thickness of several millimeters, and prevents the slip thereof with respect to the belt 31. The drive roller 32 is rotatively driven in the direction indicated by the arrow B by a pulse motor (not shown).

The primary transfer plane A is opposed to the image forming portions 10*a*-10*d*, and the photosensitive drums 11*a*-11*d* are adapted to be opposed to the primary transfer plane A of the intermediate transfer belt 31. Thus, the primary transfer areas Ta-Td are located on the primary transfer plane A. In the primary transfer areas Ta-Td wherein the photosensitive drums 11*a*-11*d* are opposed to the intermediate transfer belt 31, primary transfer chargers 35*a*-35*d* are disposed on the back of the intermediate transfer belt 31. A secondary transfer roller 36 is disposed in opposed relationship with the secondary transfer opposed roller 34, and forms the secondary transfer area Te by the nip with the intermediate transfer belt 31. The secondary transfer roller 36 is pressurized against the intermediate transfer belt 31 with moderate pressure. Also, downstream of the secondary transfer area Te on the intermediate transfer belt 31, there are provided a cleaning blade 51 for cleaning the image forming surface of the intermediate transfer belt 31, and a waste toner box 52 for containing waste toners therein.

The fixing unit 40 (FIG. 11) as a fixing apparatus, as will be described later in detail with respect to the construction thereof, is comprised of a fixing roller as a heat rotary member (fixing rotary member) provided with a heat source such as a halogen heater therein, an endless pressure belt as a pressure rotary member brought into pressure contact with the fixing roller, a guide for guiding the recording material P to the nip portion which is the pressure contact portion between the fixing roller and the pressure belt, a sheet discharging inner roller 44 and a sheet discharging outer roller 45 for further directing the recording material P discharged from the nip portion to the outside of the apparatus.

When an image forming operation start signal is transmitted from the controlling portion 80, the supply of the recording material P is started from a sheet supplying stage selected by the selected size of the recording material P.

Description will now be added in accordance with the operation of the apparatus.

When the image forming operation start signal is transmitted from the controlling portion 80, the recording materials P are first fed out one by one from the cassette 21*a* by the pickup roller 22*a* as conveying means. Then, the recording material P is guided along the sheet feeding guide 24 by the pair of sheet feeding rollers 23 as conveying means and is conveyed to the registration rollers 25*a* and 25*b* as conveying means. At that time, the registration rollers 25*a* and 25*b* are at a halt, and the leading edge of the paper abuts against the nip portion between the rollers 25*a* and 25*b*.

Thereafter, with the timing at which the image forming portions 10*a*-10*d* start the formation of images (the timing of the start of image exposure of the photosensitive member in the first image forming station) as the reference, the registration rollers 25*a* and 25*b* start to be rotated and start the conveyance of the recording material.

The rotation of the registration rollers 25*a* and 25*b* has its timing set so that the recording material P and the toner images primary-transferred from the image forming portion 10 onto the intermediate transfer belt 31 may just coincide with each other in the secondary transfer area Te.

On the other hand, in the image forming portion 10, when the image forming operation start signal from the controlling portion 80 is transmitted, the toner image (developed image) formed on the most upstream photosensitive drum 11*d* with respect to the rotation direction B of the intermediate transfer belt 31 by the aforedescribed process is primary-transferred to the intermediate transfer belt 31 in a primary transfer area Td by the primary transfer charger 35*d* having a high voltage applied thereto.

The primary-transferred toner image is carried to the next primary transfer area Tc. There, image formation is effected with a delay of the time for which the toner image is carried between adjacent image forming portions 10, and the next toner image is transferred with the registration (image position) adjusted onto the previous image. A similar process is repeated with respect to primary transfer area Ta and Tb of the other colors and after all, toner images of four colors are primary-transferred onto the intermediate transfer belt 31.

Thereafter, the recording material P enters the secondary transfer area Te and contacts with the intermediate transfer belt 31, whereupon a high voltage is applied to the secondary transfer roller 36 in timed relationship with the passage of the recording material P.

Then, the toner images of the four colors formed on the intermediate transfer belt 31 by the aforedescribed process are collectively transferred to the surface of the recording material P. Thereafter, the recording material P is accurately guided to the nip portion between the pair of fixing rollers 41 by a conveying guide 43. Then, the toner image is fixed on the surface of the recording material by the heat of the pair of fixing rollers 41 and the pressure of the nip. Thereafter, the recording material P is conveyed and discharged to the outside of the apparatus by the sheet discharging inner rollers 44 and outer rollers 45.

In order to correct the misregister of the color images formed on the photosensitive drums 11*a*-11*d*, i.e., color misregister (misregister) caused by such reasons as the mechanical mounting errors of the photosensitive drums 11*a*-11*d* in this type of image forming apparatus and the errors of the optical path lengths and changes in the optical paths of the laser beams produced by the exposing portions 13*a*-13*d*, and the warp of the LED due to the environmental temperature, a registration sensor 60 for detecting each reference toner image for misregister correction is provided at a location on the surface of the transfer area A downstream of all the image forming portions 10 and at a location before the belt 31 is turned back by the drive roller 32.

In the present embodiment, the types of the recording material P as the recording material are diversified and use can be made of plain paper having an ordinary thickness, thick paper thicker than the plain paper, and further the coat paper, the OHP sheet, etc. as described above. Of course, as regards the sizes of the recording material P, use can be made of a small size such as a postcard, and a large size such as A3 paper.

<Fixing Apparatus>

Figure 1:
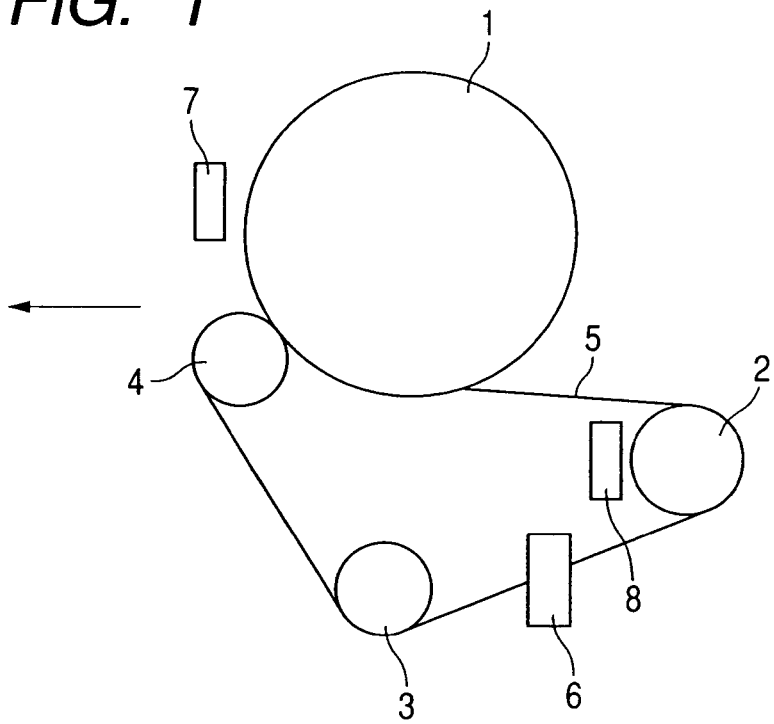
FIG. 1 shows a fixing apparatus according to an embodiment of the present invention.

FIG. 1 is a cross-sectional view of the essential portions of the fixing apparatus 40 to which the present invention can be applied.

In FIG. 1, a heater is disposed in the interior of the fixing roller 1. A fixing roller thermistor 7 is provided outside the fixing roller 1, and when the temperature is to be controlled for the passing of the recording material P, the heater is turned on/off while the temperature is monitored by the fixing roller thermistor 7, and the temperature is controlled by a controlling apparatus so as to be stabilized at a predetermined temperature. Also, the fixing roller 1 is rotatively driven for the passing of the recording material P, and is rotated so as to convey the recording material P in the direction indicated by the arrow in FIG. 1.

The pressure belt 5 is shown as being in contact with the fixing roller 1, and the belt 5 is stretched around so as to surround three rollers, i.e., a drive roller 2, a steering roller 3 and a separating roller 4.

This belt 5 rotatively drives the drive roller 2 to be rotated so as to convey the recording material P in the direction indicated by the arrow in FIG. 1 during the passing of the recording material P. The steering roller 3 and the separating roller 4 are driven to rotate by the belt 5 being rotatively driven by the rotation of the drive roller 2 and assist the rotation of the belt 5. A heater is disposed in the interior of the drive roller 2, and a drive roller (belt) thermistor 8 is provided outside the drive roller 2, and when the temperature is to be controlled for the passing of the recording material P, the heater is turned on/off while the temperature is monitored by the belt thermistor 8 as temperature detecting means, and the temperature is controlled by the controlling apparatus so as to be stabilized at a predetermined temperature, and the surface temperature of the drive roller 2 is transmitted to the belt 5, and the belt is rotatively driven, whereby the temperature can be transmitted to the entire belt 5.

During the passing of the recording material P, the fixing roller 1 and the belt 5 are rotated while controlling the temperature, whereby heat is applied to the recording material P passed between the fixing roller 1 and the belt 5 to thereby fix the image thereon. A sensor 6 for detecting the deviated state of the belt 5 is disposed on the inner part side and this side as viewed in FIG. 1. The inclination of the steering roller is changed in accordance with the output of the sensor 6 for detecting the deviation of the belt to thereby swing the belt in the width direction thereby.

In the present embodiment, there is adopted a construction in which the pressure belt is spaced apart from the fixing roller when the fixing process is completed, and as will be described later, design is made such that in starting the fixing process, the pressure belt is brought into contact with the fixing roller. Also, when the fixing process is to be continuously carried out on a plurality of recording materials, the pressure belt is kept in contact with the fixing roller, and the pressure belt is spaced apart from the fixing roller at a point of time whereat such a continuous image forming job has been terminated. In such a state, the fixing apparatus stands by until the start signal of the next image forming job is inputted.

Figure 2:
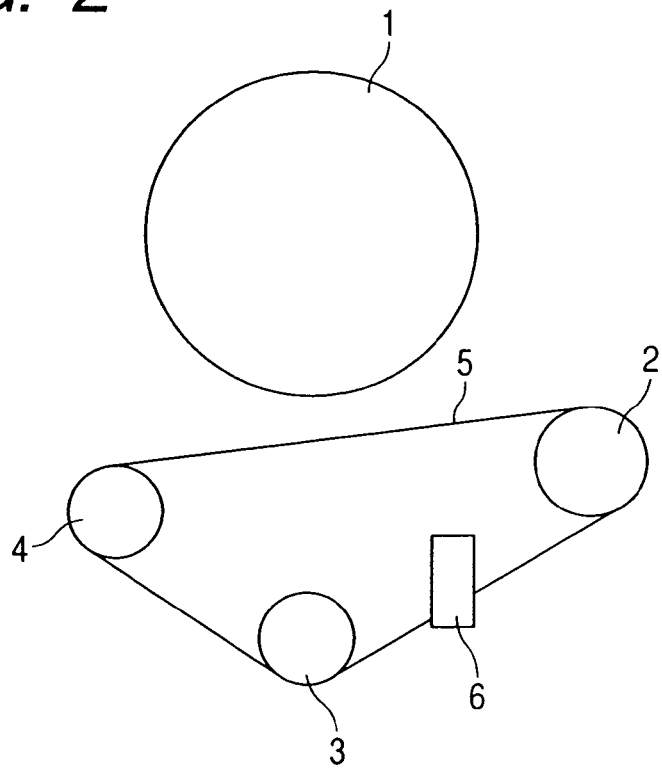
FIG. 2 shows the fixing apparatus according to the embodiment of the present invention as it is in a spaced-apart state.

FIG. 2 shows a state in which the belt 5 is spaced apart from the fixing roller 1, and the belt 5 is rotated about the drive roller 2. By the belt being spaced apart, deformation by the fixing roller 1 being left unused for a long time is prevented from occurring. Even in a spaced-apart state, the belt 5 can be temperature-controlled, and the drive roller 2 can be rotated to thereby rotatively move the belt 5. In this state, the recording material P cannot be conveyed in the direction indicated by the arrow in FIG. 1.

Figure 3:
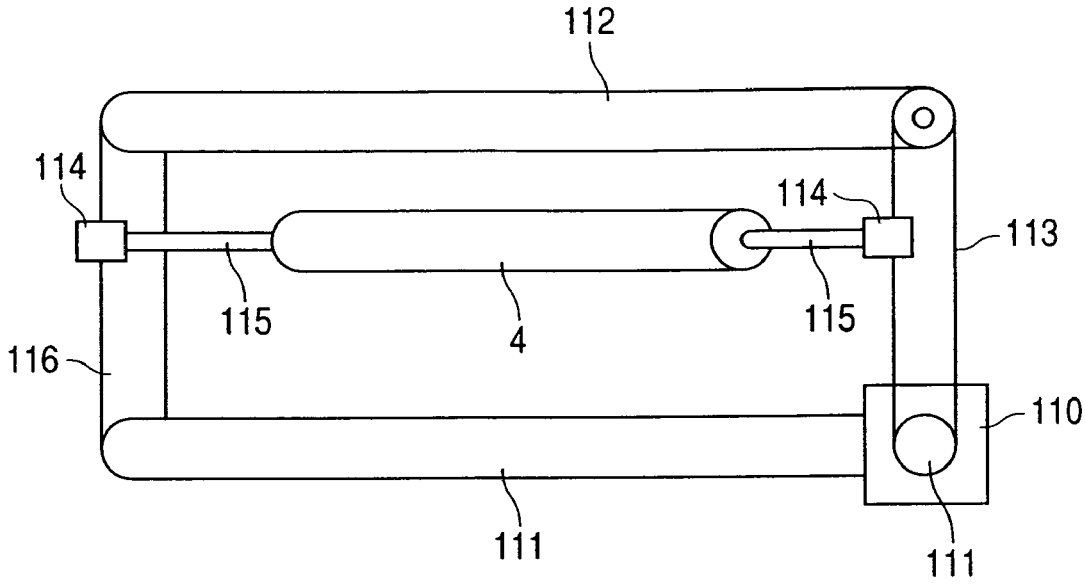
FIG. 3 is a conceptual view showing the mounting and dismounting mechanism of the fixing apparatus according to the embodiment of the present invention.

FIG. 3 shows a driving system for rocking the separating roller in the rotation direction with the drive roller 2 as the center of rotation to move the belt toward and away from the fixing roller as shown in FIGS. 1 and 2. This FIG. 3 is a view of the fixing apparatus of FIG. 1 as it is seen from a discharging direction, i.e., from obliquely left in FIG. 1.

In this FIG. 3, the drive source of the separating roller 4 is a pulse motor 110, and the shaft 111 of the pulse motor 110 is connected to an opposed driven shaft 112 by a moving belt 113, and the pulse motor 110 is rotatively driven, whereby the moving belt 113 is moved and the driven shaft 112 is also rotated.

The pulse motor shaft 111 and the driven shaft 112 are roller shafts from the front side to the back side of the fixing apparatus, and design is made such that on the back side, a moving belt 116 rotatively drives the pulse motor 110, whereby in operative association with the front side, it is moved in the same direction.

A fixing portion 114 for fixing the shaft 115 of the separating roller 4 is provided on a portion of the moving belt 113, and the fixing portion 114 is fixed to the moving belts 113 and 116, and when the moving belts are rotatively moved, the fixing portion 114 is vertically moved to thereby effect the vertical driving of the separating roller 4. Also, the vertical movement distance can be controlled by the pulse number forwarded to the pulse motor 110, and the vertical direction can be controlled by the rotation direction in which the pulse number is forwarded to the pulse motor 110.

Also, design is made such that a pressure pad (not shown) for pressurizing the pressure belt toward the fixing roller in the nip portion effects the movement toward and away from the fixing roller in synchronism with the fixing portion.

Figure 4:
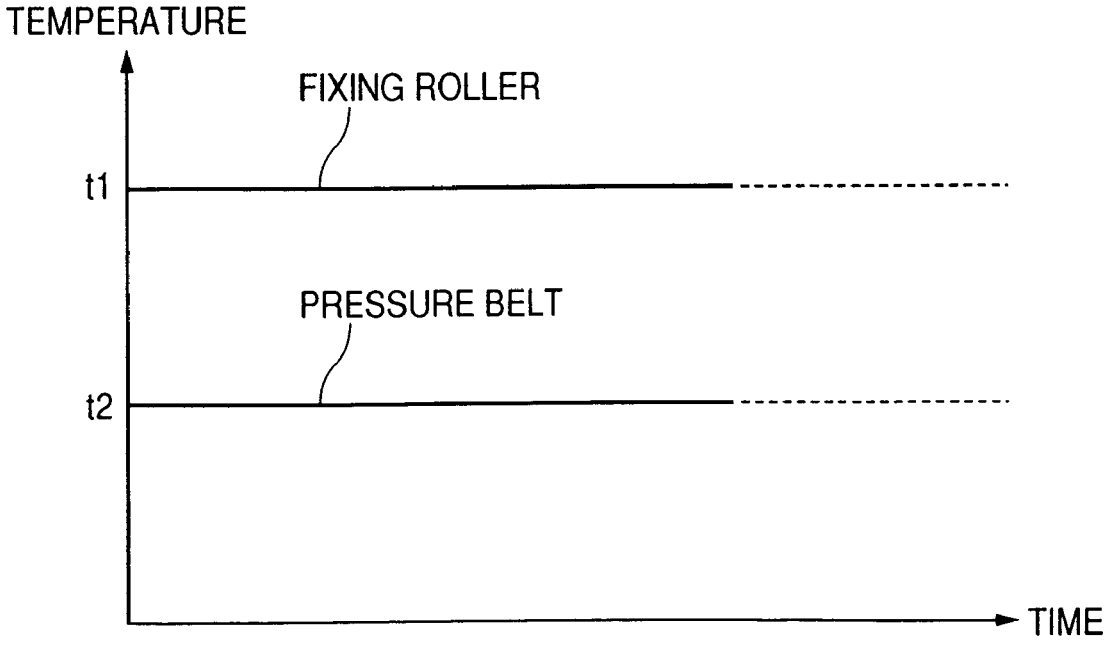
FIG. 4 shows the temperature transition when the fixing apparatus according to the embodiment of the present invention is spaced apart.

FIG. 4 shows the temperatures of the fixing roller thermistor 7 and the belt thermistor 8 during the standby (during the image formation standby between an image forming job and the next image forming job), and the fixing roller 1 and the belt 5 are in a spaced-apart state. Here, the fixing roller thermistor 7 is stably temperature-controlled at a temperature t1, and the belt thermistor 8 is temperature-controlled at a temperature t2 (<t1).

Figure 5:
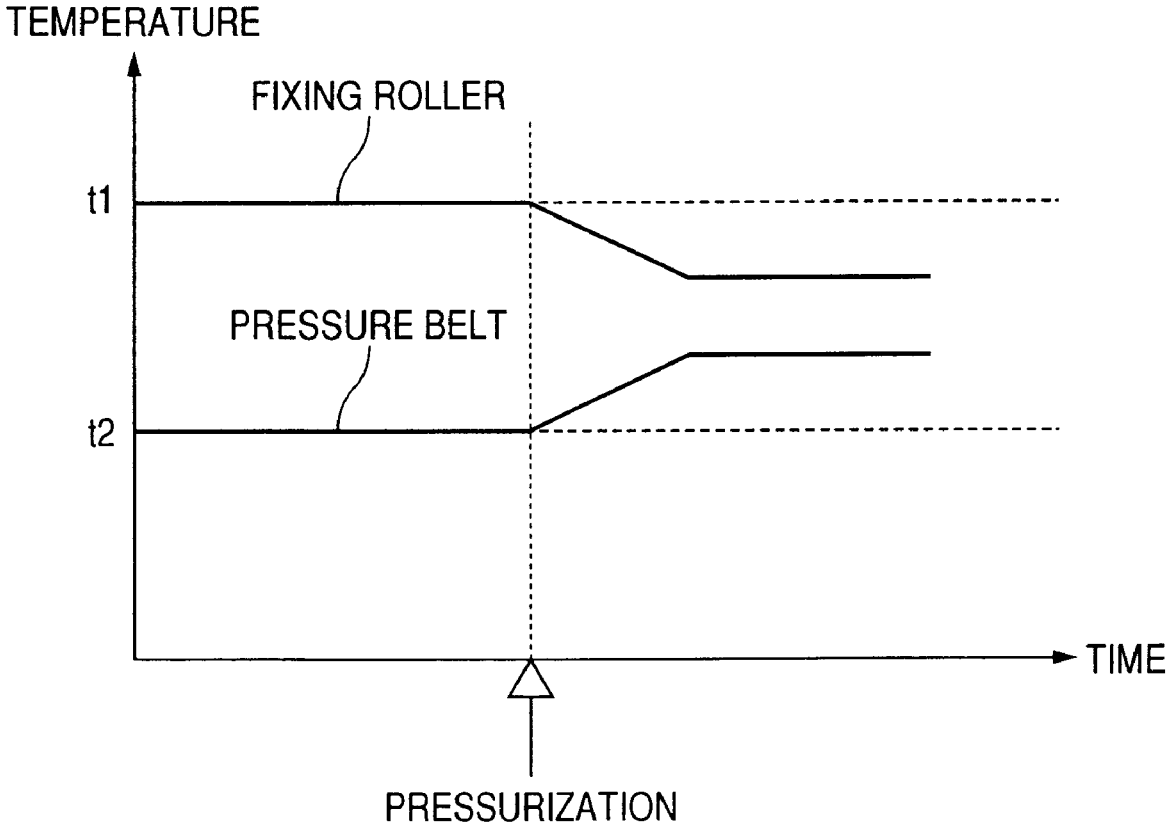
FIG. 5 shows the temperature transition when the fixing apparatus according to the embodiment of the present invention is brought into pressure contact.

FIG. 5 shows the transition state of the detected temperatures of the fixing roller thermistor 7 and the belt thermistor 8 after the belt 5 has been brought into pressure contact with the fixing roller 1 with the inputting of the image formation start signal, from the state of FIG. 4 in which the thermistors were stably temperature-controlled.

The detected temperature of the fixing roller thermistor 7, when the belt 5 is brought into contact with the fixing roller, is gradually lowered by the temperature difference from the belt 5 temperature-controlled at a lower temperature than the fixing roller 1, and is stabilized at a certain temperature.

The detected temperature of the belt thermistor 8, when the belt 5 is brought into contact with the fixing roller, gradually rises by the temperature difference from the fixing roller 1 temperature-controlled at a higher temperature than the belt 5, and is stabilized at a certain temperature.

As regards these stable temperatures, the heater in the fixing roller 1 effects the temperature control which attempts to always return to the temperature t1, whereas the target temperature of the belt 5 is set to the temperature t2 lower than the temperature t1 and therefore, the temperature difference of the fixing roller 1 transmits to the belt 5, and the heater in the drive roller 2 of the belt is turned off.

The belt, except for the portion thereof which is in contact with the fixing roller 1, tends to cool down and therefore, does not assume the same degree of temperature as the fixing roller 1, but the temperature of the belt becomes stable so as to maintain a predetermined temperature difference and therefore, it is possible to prevent the faulty fixing that the recording material becomes inseparable from the belt.

Figure 6:
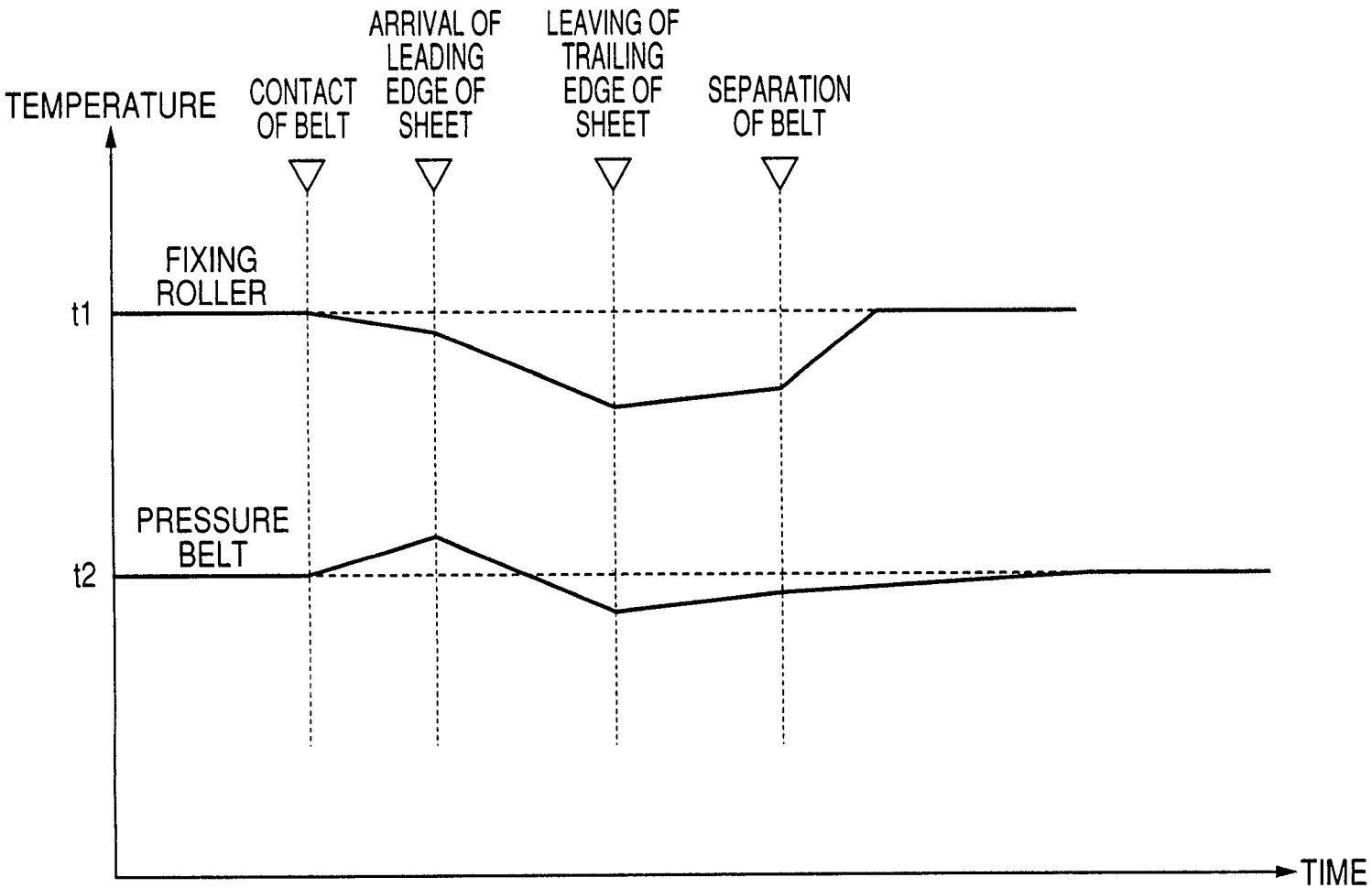
FIG. 6 shows the transition of a fixing temperature including the passing of a recording material during copying.

FIG. 6 shows the temperature transition states of the fixing roller thermistor 7 and the belt thermistor 8 when the continuous passing of the recording materials P was effected in the stable temperature-controlled states in FIGS. 4 and 5.

Referring to FIG. 6, the temperature control of the heater heating the fixing roller is effected so that the detected temperature of the fixing roller thermistor 7 may be stabilized at t1, and in the standby state until the belt is brought into contact, the temperature of the fixing roller is t1. On the other hand, the temperature control of the heater heating the belt is effected so that the detected temperature of the belt thermistor 8 may be stabilized at t2, and in the standby state until the belt is brought into contact, the temperature of the belt is t2.

Immediately before the copying operation is started with the inputting of the image formation start signal and the recording material P arrives at the fixing apparatus, the pulse motor 110 is driven to thereby elevate the separating roller 4, whereby the belt 5 is brought into contact with the fixing roller 1, and a preparation for starting the fixing process is made (the "contact of belt" point in FIG. 6).

When the belt 5 is brought into pressure contact with the fixing roller 1, the detected temperature of the fixing roller thermistor 7 lowers and the detected temperature of the belt thermistor 8 rises, as shown in FIG. 5. When the leading edge of the recording material P arrives at the fixing apparatus (the "arrival of leading edge of sheet" point in FIG. 6) when the detected temperatures of the two thermistors are transmitting heat is given from the fixing roller 1 and the belt 5 to the recording material P bearing an image thereon, whereby the temperatures of both of the fixing roller thermistor 7 and the belt thermistor 8 are lowered.

In the case of the passing (fixing process) of a single recording material P, the temperature lowering is small, but when a many sheets are passed, the temperature lowering becomes great. When the trailing edge of the last sheet leaves the fixing apparatus (the "leaving of trailing edge of sheet" point in FIG. 6), the temperatures of both of the fixing roller thermistor 7 and the belt thermistor 8 start to rise, and when the belt is spaced apart from the fixing roller to keep the life of the fixing apparatus (the "separation of belt" point in FIG. 6), it does not happen that the heat is taken from the fixing roller 1 by the belt 5 and therefore, the detected temperature of the fixing roller thermistor 7 is returned to the stable temperature t1 within a short time by the above-described temperature control.

The belt 5 is designed to be locally heated and temperature-controlled by only the heater in the drive roller 2 and therefore, the temperature of the belt gradually rises by being spaced apart from the fixing roller 1, and is returned to the stable temperature t2 at timing slower than the timing at which the fixing roller 1 is returned to t1.

Figure 7:
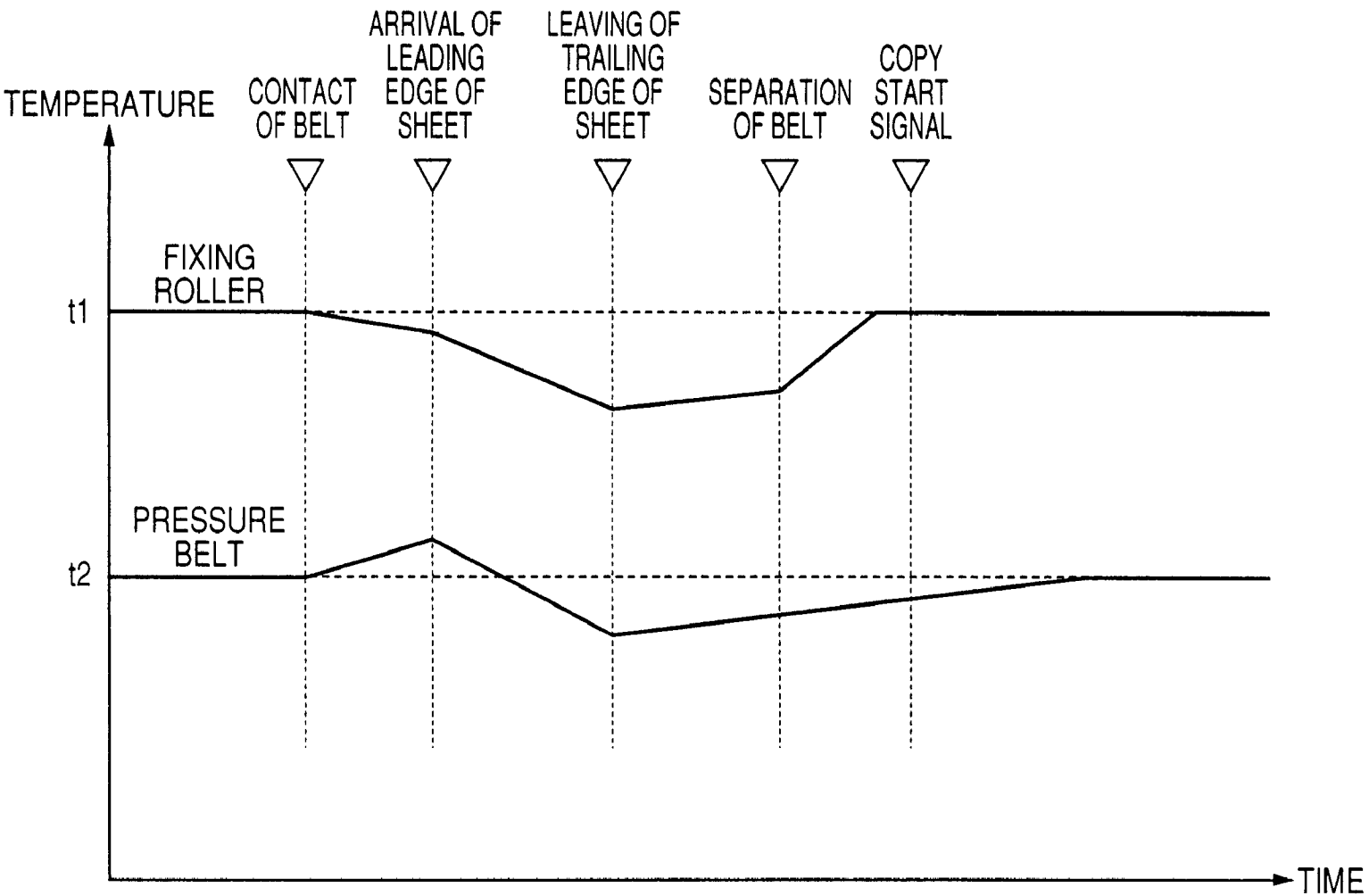
FIG. 7 shows the transition of the fixing temperature at the start of copying after the continuous passing of sheets.

FIG. 7 shows the detected temperature transition states of the fixing roller thermistor 7 and the belt thermistor 8 when the next copying operation has been started after the termination of the copying operation described in connection with FIG. 6.

As shown in FIG. 7, it will be seen that after the fixing process in the previous copying operation has been terminated and the belt has been spaced apart from the fixing roller, the temperature of the fixing roller 1 is returned to the stable temperature t1 within a short time, but the belt 5 is not returned to the stable temperature t2 within a short time.

If at this time, the next copy start signal is inputted, in a construction wherein as in the conventional art, the belt is brought into contact with the fixing roller at uniform timing, the belt is not returned to its fixing temperature at a point of time whereat the recording material P dashes into the fixing nip and therefore, faulty fixing occurs.

In order to cope with such a problem, in the present embodiment, the control of changing the timing for bringing the belt into contact with the fixing roller in accordance with the temperature of the belt is effected.

Figure 8:
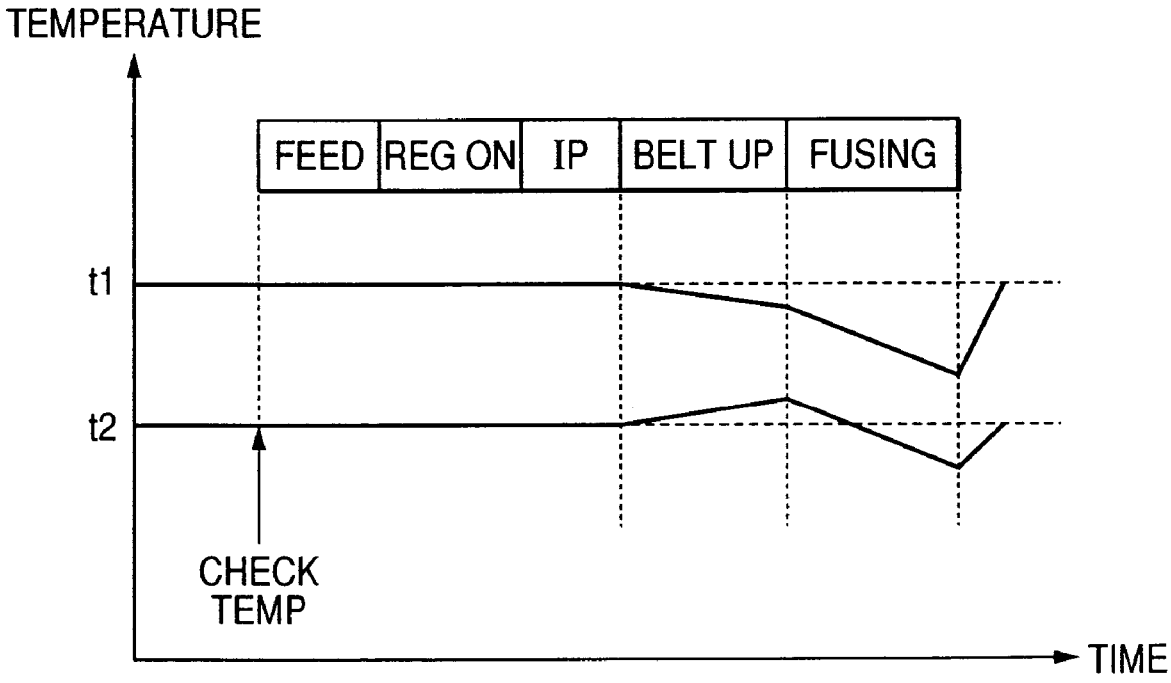
FIG. 8 shows the transition of the fixing temperature during stable temperature control.

FIG. 8 represents the timing for detecting and checking up the temperature of the belt by the belt thermistor 8 when the copy start signal is inputted and the copying operation is started ("Check Temp" in FIG. 8), the timing for picking up the recording material P from the sheet supplying cassette ("Feed" in FIG. 8), the timing for starting to convey the recording material made to stand by at the registration rollers to the secondary transferring portion ("Reg On" in FIG. 8), the timing for secondary-transferring the full-color image on the intermediate transfer member to the fed recording material P ("IP" in FIG. 8), the timing for bringing the belt into contact with the fixing roller ("Belt Up" in FIG. 8), and the timing at which the recording material P having the full-color image formed thereon dashes into the fixing nip ("Fusing" in FIG. 8).

Referring to FIG. 8, when the copy start signal is inputted, whether the detected temperatures of the fixing roller thermistor 7 and the belt thermistor 8 have reached the stable temperatures t1 and t2, respectively, is checked up.

If here, a considerable time has elapsed from the termination of the preceding image formation and both of the thermistors have reached the stable temperatures, the pickup rollers 22*a*, 22*b* and 26 in FIG. 11 start to be driven to thereby start sheet feeding ("Feed")

The registration rollers 25*a* and 25*b* are stopped from rotating so as to temporarily wait for the fed recording material P, and after synchronized with the toner images on the intermediate transfer belt 31, the registration rollers 25*a* and 25*b* are rotatively driven to thereby resume the conveyance of the recording material ("Reg On").

The recording material P conveyed to the secondary transferring portion receives the transfer of the toner images of four colors formed on the intermediate transfer belt 31 by a high voltage being applied to the secondary transfer roller 36, and is intactly conveyed toward the fixing apparatus ("IP").

Before the recording material P having received the transfer of the toner images arrives at the fixing nip, the pulse motor 110 is driven to thereby elevate the separating roller 4, whereby the belt 5 is brought into contact with the fixing roller 1 and a preparation for the fixing process is made ("Belt Up").

Thereafter, the toner image is heated, pressurized and fixed on the recording material P while the recording material P is nipped and conveyed between the fixing roller 1 and the belt 5 in the fixing nip ("Fusing"), and the recording material P is discharged (to the sheet discharging tray) outside the image forming apparatus.

The control flow of the contact timing of the belt will now be described with reference to FIG. 9.

When a copy button is depressed (when the input of a copy start signal is received by a controlling apparatus CPU), as to whether the fixing apparatus has become capable of copying, the detected temperatures of the fixing roller thermistor 7 and the belt thermistor 8 are checked up (201).

If the temperature of the belt thermistor 8 is higher than the temperature t2 which is the stable temperature (202), advance is made to a step (1), where the sheet feeding operation is started (203), and the recording material P is once stopped at the registration rollers 25*a* and 25*b*, and is synchronized with the toner images on the intermediate transfer belt 31, whereafter the registration rollers 25*a* and 25*b* are rotatively driven to thereby resume the conveyance of the recording material P (204). The recording material P of which the conveyance has been resumed has the toner images on the intermediate transfer belt 31 transferred thereonto by the secondary transfer roller 36 (205), and before the recording material P having received the transfer and conveyed arrives at the fixing nip, the separating roller 4 is elevated to thereby bring the belt 5 into pressure contact with the fixing roller 1 (206). After the pressure contact, the toner image transferred onto the recording material P in the fixing nip is fixed (207), and it is waited for the trailing edge of the recording material on which the toner image has been fixed to leave the fixing nip (208).

When the trailing edge of the recording material P leaves the fixing nip, the pulse motor 110 is driven to thereby lower the separating roller 4, whereby the belt 5 is spaced apart from the fixing roller 1 (209).

On the other hand, when the input of the next copy start signal is received when much time has not elapsed after the completion of the preceding copying operation, there exists a case where the detected temperature of the belt thermistor 8 is lower than the temperature t2 which is the stable temperature. The following is an explanation about such a case.

If the detected temperature of the belt thermistor 8 is lower than the temperature t2 which is the stable temperature (202), whether it is a temperature t3 which is lower than the temperature t2 or higher is judged (212). If as the result of the judgment, it is the temperature t3 or higher, advance is made to a step (2), where the sheet feeding operation is started (213), and the recording material P is once stopped at the registration roller 25*a* and 25*b*, and is synchronized with the toner image on the intermediate transfer belt 31, whereafter the registration rollers 25*a* and 25*b* are rotatively driven to thereby resume the conveyance of the recording material P (214). After the conveyance of the recording material P has been resumed, the separating roller 4 is elevated earlier than at the step (1) in order to eliminate a temperature difference of (t2−t3), to thereby bring the belt 5 into pressure contact with the fixing roller 1 (215). By thus bringing the belt into contact with the fixing roller earlier, it is possible to raise the temperature of the belt 5 at the point of time whereat the fixing process is started to a proper temperature, and prevent the occurrence of faulty fixing.

Thereafter, the toner image on the intermediate transfer belt 31 is transferred onto the recording material P by the secondary transfer roller 36, and since the belt 5 is already in contact with the fixing roller 1 and the temperature thereof is made proper, the toner image transferred onto the recording material P is fixed in the fixing nip (207).

Next, if the detected temperature of the belt thermistor 8 is t3 or lower (212), whether it is a temperature t4 which is lower than the temperature t3 or higher is judged (222). If as the result of the judgment, it is the temperature t4 or higher, advance is made to a step (3), where the sheet feeding operation is started (223), whereafter in order to eliminate a temperature difference of (t2−t4), the separating roller 4 is elevated still earlier than at the step (2) to thereby bring the belt 5 into pressure contact with the fixing roller 1 (224). By thus further quickening the contact timing of the belt with the fixing roller than at the step (2), it is possible to raise the temperature of the belt at the point of time whereat the fixing process is started to a proper temperature, and prevent the occurrence of faulty fixing.

Thereafter, the recording material P is once stopped at the registration rollers 25*a* and 25*b*, and is synchronized with the toner image on the intermediate transfer belt 31, whereafter the registration rollers 25*a* and 25*b* are rotatively driven to thereby resume the conveyance of the recording material P (225), and the toner image on the intermediate transfer belt 31 is transferred onto the recording material P (226), and since the belt 5 is already in pressure contact with the fixing roller 1, the toner image transferred onto the recording material P is fixed by the fixing apparatus (207).

Next, if the detected temperature of the belt thermistor 8 is t4 or lower (222), whether it is a temperature t5 which is lower than the temperature t4 or higher is judged (232). If as the result of the judgment, the detected temperature is t5 or higher, advance is made to a step (4), and in order to eliminate a temperature difference of (t2−t5), the separating roller 4 is elevated still earlier than at the step (3) to thereby bring the belt 5 into pressure contact with the fixing roller 1 (233). By thus further quickening the contact timing of the belt with the fixing roller than at the step (3), it is possible to raise the temperature of the belt 5 at the point of time whereat the fixing process is started to a proper temperature, and prevent the occurrence of faulty fixing.

Thereafter, the sheet feeding operation is started (234), and the recording material P is once stopped at the registration rollers 25*a* and 25*b*, and is synchronized with the toner image on the intermediate transfer belt 31, whereafter the registration rollers 25*a* and 25*b* are rotatively driven to thereby resume the conveyance of the recording material P (235), and the toner image on the intermediate transfer belt 31 is transferred onto the recording material P by the secondary transfer roller 36 (236), and since the belt 5 is already in pressure contact with the fixing roller 1, the toner image transferred onto the recording material P is fixed by the fixing apparatus (207).

Next, if the detected temperature of the belt thermistor 8 is t5 or lower (232), it is known that even if the sheet feeding operation is started, the temperature of the belt thermistor 8 is not returned to the stable temperature t2 or higher by the time the recording material P arrives at the fixing apparatus and therefore, advance is made to a step (5), where the separating roller 4 is elevated to thereby bring the belt 5 into pressure contact with the fixing roller 1 (241). Thereafter, the belt is heated by its contact with the fixing roller 1, and it is waited for the detected temperature of the belt thermistor 8 to become t5 or higher (242). When the detected temperature of the belt thermistor 8 becomes t5 or higher, advance is made to a flow similar to the step (4).

That is, the sheet feeding operation is started (244), the recording material P is once stopped at the registration rollers 25*a* and 25*b*, and is synchronized with the toner image on the intermediate transfer belt 31, whereafter the registration rollers 25*a* and 25*b* are rotatively driven to thereby resume the conveyance of the recording material P (245), and the toner image on the intermediate transfer belt 31 is transferred onto the recording material P by the secondary transfer roller 36 (246), and since the belt 5 is in pressure contact with the fixing roller 1, the toner image transferred onto the recording material P is fixed by the fixing apparatus (207).

Figure 9:
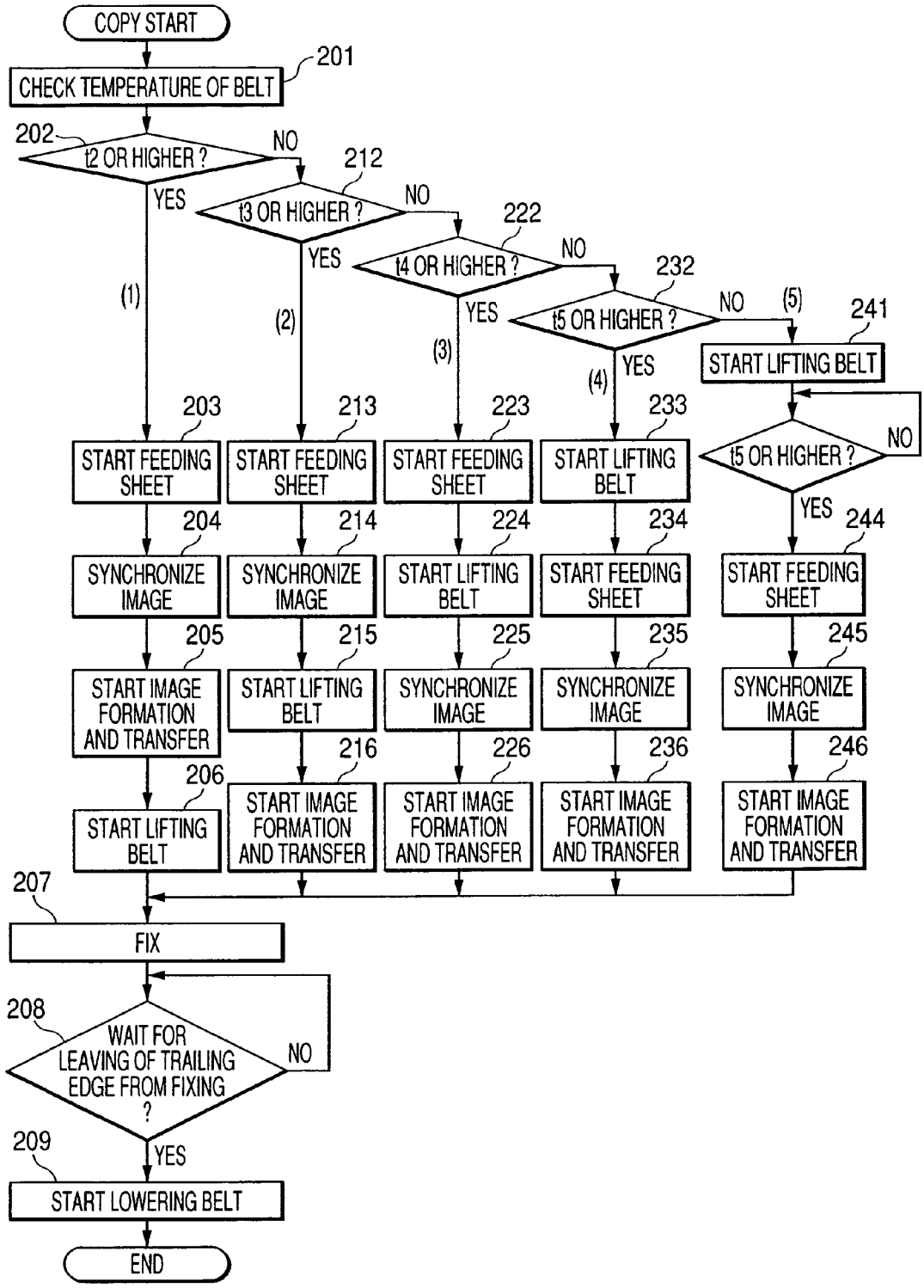
FIG. 9 is a flow chart showing the processing of the present invention.
Figure 10:
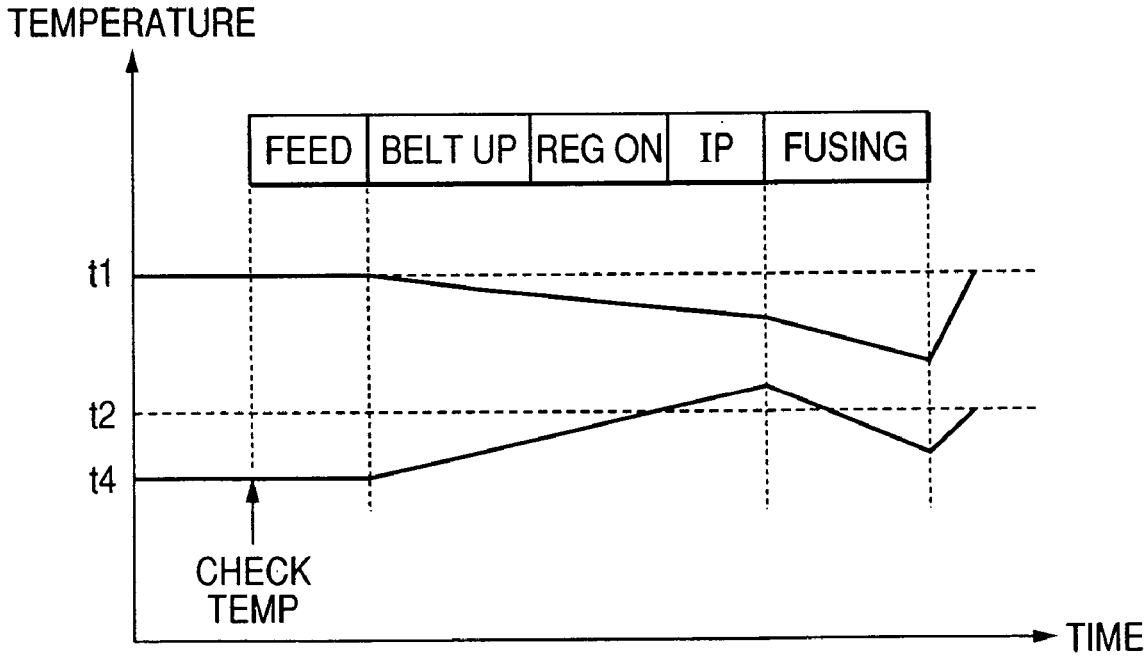
FIG. 10 shows the transition of the fixing temperature when the productivity of the embodiment of the present invention is not lowered.

As an example of the flow chart of FIG. 9, the temperature transition conceptual view when at the step of (222), the detected temperature of the belt thermistor 8 was t4 or higher is such as shown in FIG. 10.

Referring to FIG. 10, when a demand for the copy start comes, whether the temperatures of the fixing roller thermistor 7 and the belt thermistor 8 have reached the stable temperatures t1 and t2, respectively, is checked up, and since the temperature of the belt thermistor 8 was t4 or higher, the pickup rollers 22*a*, 22*b* and 26 in FIG. 11 start to be driven to thereby start sheet feeding ("Feed" in FIG. 10) and also, the pulse motor 110 is driven and the separating roller 4 is elevated to thereby bring the belt 5 into pressure contact with the fixing roller 1, and a preparation for passing the recording material P is made ("Belt Up" in FIG. 10).

The fed recording material P is once stopped at the registration rollers 25*a* and 25*b*, and is synchronized with the toner image on the intermediate transfer belt 31, whereafter the registration rollers 25*a* and 25*b* are rotatively driven to thereby resume the conveyance of the recording material P ("Reg On" in FIG. 10). The recording material P of which the conveyance has been resumed receives the transfer of the toner image of four colors formed on the intermediate transfer belt 31 by a transferring bias being applied to the secondary transfer roller 36 ("IP" in FIG. 10). The recording material P having received the transfer and intactly conveyed has the toner image thereon fixed by the fixing apparatus ("Fusing" in FIG. 10), and is discharged to the outside of the apparatus.

Figure 12:
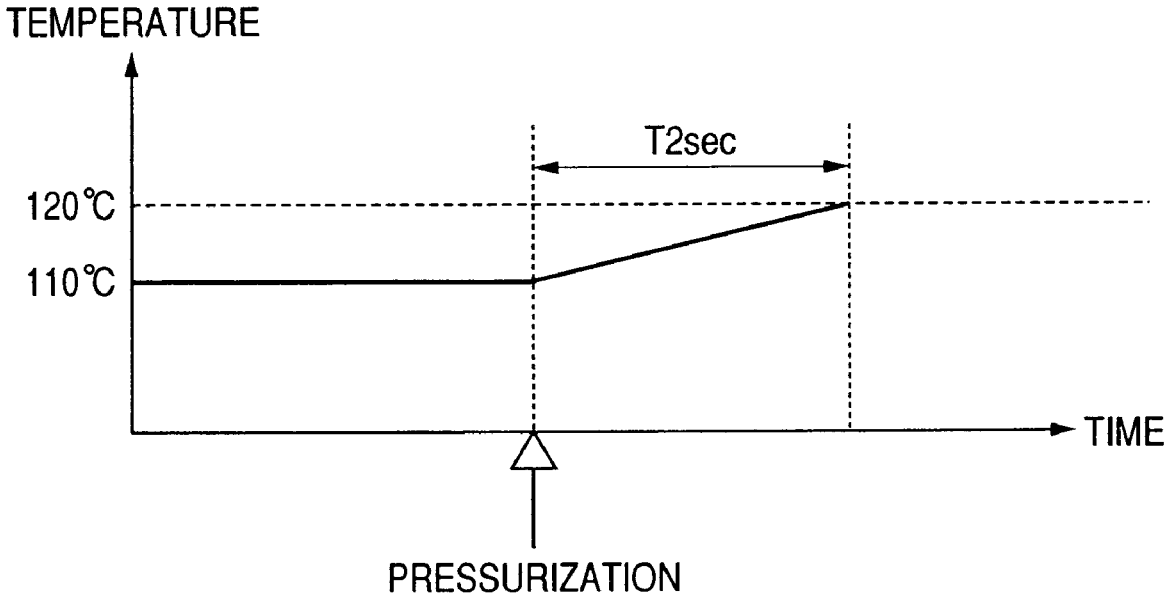
FIG. 12 shows the temperature transition of a pressure belt.

The hitherto described temperature conditions t3, t4 and t5 of the belt thermistor 8 will be further described with reference to FIG. 12. FIG. 12 shows the temperature transition of the belt thermistor 8.

It is shown that at the "pressurization" point in FIG. 12, the belt 5 is brought into pressure contact with the fixing roller 1, and in T2 seconds after the timing of pressure contact, the temperature of the belt thermistor 8 has risen by 10° C. If here, T2 seconds is 10 seconds, the temperature of the belt thermistor 8 rises by 1° C. during 1 second by the pressure contact.

When in such a construction, in FIG. 11, the time required for the conveyance of the recording material P from each pickup roller 22*a* to the registration rollers 25*a* and 25*b* is defined as T4 seconds, and the time required for the conveyance of the recording material P from the registration rollers 25*a* and 25*b* to the secondary transferring portion by the secondary transfer roller 36 is defined as T5 seconds, and the time required for the conveyance of the recording material P from the secondary transfer roller 36 to the fixing nip is defined as T6 seconds, in a case where the belt 5 is brought into pressure contact with the fixing roller at a point of time whereat the recording material P has arrived at the secondary transferring portion, it is supposed that during the time until the recording material P arrives at the fixing nip, the belt 5 rises in temperature by T6 ° C. by the fixing roller. Also, in a case where the belt 5 is brought into pressure contact with the fixing roller at a point of time whereat the conveyance of the recording material P has been started by the registration rollers 25*a* and 25*b*, it is supposed that during the time until the recording material P arrives at the fixing nip, the belt 5 rises in temperature by (T5+T6) ° C. by the fixing roller. Also, in a case where the belt 5 is brought into pressure contact with the fixing roller at a point of time whereat a recording material has been picked up from the sheet supplying cassette as a recording material containing portion by each pickup roller 22*a*, it is supposed that during the time until the recording material P arrives at the fixing nip, the belt 5 rises in temperature by (T4+T5+T6) ° C. by the fixing roller.

Consequently, when the above-mentioned parameter is used, the temperature t3 (° C.) in the flow chart of FIG. 9 becomes $$t3<t2-(T5+T6),$$

the temperature t4 (° C.) becomes $$t4<t2-(T4+T5+T6),$$

and the temperature t5 (° C.) assumes the relation that $$t5=t2-(T4+T5+T6).$$

While description has been made here of an example in which the timing for bringing the belt 5 into contact with the fixing roller 1 is set with the start of the driving of the pickup rollers (the start of sheet feeding), the start of the driving of the registration rollers and the start of the secondary transfer as the reference, design may be made such that the timing for bringing the belt 5 into pressure contact with the fixing roller 1 is arbitrarily set so that by calculating back from the timing at which the leading edge of the recording material P dashes into the fixing nip, by the above-described calculation, the detected temperature of the belt thermistor 8 may be the stable temperature t2 or higher when the leading edge of the recording material P dashes into the fixing nip.

For example, when the above-described example is used, if the detected temperature of the belt thermistor 8 is (t2−15) ° C. when the input of the copy start signal has been received, it becomes possible to produce a contact timing signal for bringing the belt 5 into contact with the fixing roller 1 so that the belt 5 may contact with the fixing roller 1 at 15 seconds before the leading edge of the recording material P dashes into the fixing nip.

Alternatively, it is also possible to produce a contact timing signal for bringing the belt 5 into contact with the fixing roller 1 with a point of time at which the image forming apparatus has received the input of the copy start signal as the reference.

The contact timing signal thus produced by the controlling apparatus (CPU) is suitably transmitted to the fixing apparatus, and specifically is transmitted to a driving system for elevating the separating roller, whereby the pressure belt contacts with the fixing roller.

As described above, in expectation that the temperature of the belt 5 becomes a temperature which can secure a fixing property at a point of time whereat the fixing process is started, a copy starting operation (a sheet feeding operation by the pickup rollers) is started before the temperature of the belt 5 becomes the temperature which can secure the fixing property and therefore, the throughput of image formation can be improved as far as possible.

As hitherto described, in accordance with the detected temperature of the pressure belt, the contact timing of the pressure belt with the fixing roller is changed and controlled by the controlling apparatus (CPU) so that the pressure belt may not rise in temperature more than necessary by the contact thereof with the fixing roller, but the temperature of the pressure belt at the point of time whereat the fixing process is started may be within a predetermined temperature range lower than the temperature of the fixing roller, whereby it is possible to prevent the occurrence of faulty fixing due to low temperature offset, high temperature offset and the diffusion of vapor in coat paper, and faulty fixing such as the faulty separation of the recording material.

Also, in the present embodiment, when image formation is to be continuously effected on a plurality of recording materials, it is possible to prevent the above-noted faulty fixing without spoiling the usability by a reduction in the throughput of image formation, that is, with the number of image-formed sheets per unit time (the number of fixing-processed sheets per unit time) maintained at a predetermined value.

Also, when the next image forming job is demanded immediately after a continuous image forming job, the time from after the start signal of an image forming job has been inputted until the termination of the image formation on the first sheet in that image forming job, i.e., the so-called first print time, can be shortened as far as possible.

Also, it becomes possible to shorten the contact time of the pressure belt with the fixing rotary member to the utmost and therefore, in a case where the movement speeds of the pressure belt and the fixing rotary member in the fixing nip do not completely coincide with each other, it is possible to prevent a reduction in the durable lives of the pressure belt and the fixing rotary member.

While in the above-described embodiment, there is adopted a construction in which the timing for bringing the pressure belt into contact with the fixing roller is changed and controlled in accordance with the detected temperature of the pressure belt by the controlling apparatus (CPU), there may be adopted such a construction as will be described below.

That is, on the basis of a parameter having a correlation with the temperature of the pressure belt at a point of time whereat the copy button of an operating portion has been depressed, whereby an image formation start signal has been inputted, the timing for bringing the pressure belt into contact with the fixing roller is changed and controlled by the controlling apparatus (CPU). This is, for example, a construction in which the time elapsed from after the trailing edge of the preceding (last) recording material has passed through the fixing nip is measured by timer means, and in accordance with this measured time elapsed, the timing for bringing the pressure belt into contact with the fixing roller is changed and controlled by the controlling apparatus (CPU). Specifically, in a case where the time elapsed is shorter than a predetermined time, the pressure belt is at a low temperature and therefore, in such case, the pressure belt is brought into contact with the fixing roller earlier, while on the other hand, in a case where the time elapsed is longer than the predetermined time, the pressure belt is at a high temperature and therefore, in such case, the pressure belt is brought into contact with the fixing roller later than in the aforedescribed case. In the case of such a construction, temperature detecting means for the pressure belt need not be provided, and this leads to the simplification of the apparatus.

However, the construction in which in accordance with the detected temperature of the pressure belt, the timing for bringing the pressure belt into contact with the fixing roller is changed and controlled by the controlling apparatus (CPU) is more preferable in that as previously described, fine control becomes possible and faulty fixing can be reliably prevented.

While in the foregoing, an image forming apparatus in which images formed by a plurality of image forming stations are successively superposed and primary-transferred onto an intermediate transfer member, and these images are collectively secondary-transferred to a recording material has been described as an example, the image forming apparatus to which the present invention can be applied is not restricted thereto. For example, the present invention is also applicable to an image forming apparatus in which a developing rotary carrying a plurality of (e.g. four) developing devices around a single image forming station, i.e., a single photosensitive member is rotatably provided, and during the time when an intermediate transfer member makes a plurality of revolutions (e.g. four revolutions), toner images formed on the photosensitive member are successively superposed and primary-transferred onto the intermediate transfer member, and these images are collectively secondary-transferred to a recording material.

Also, while in the foregoing, a case where the image forming apparatus is used as a copying machine in which an original is read by an image reading portion and on the basis of this read image information, an image is formed has been described as an example, the present invention is likewise applicable to a case where the image forming apparatus is used as a printer or a facsimile apparatus. In this case, "the image forming apparatus receives the input of a copy start signal" can be expressed in other words, that is, "the image forming apparatus receives the input of an image formation start signal "from an external device such as a personal computer circuit-connected to the image forming apparatus by a LAN cable. Other constructions can also be suitably applied to thereby equally apply the present invention.

This application claims priority from Japanese Patent Application No. 2004-305732 filed Oct. 20, 2004, which is hereby incorporated by reference herein.

What is claimed is:

1. An image heating apparatus comprising:

a heat rotary member for heating an image formed on a recording material in a nip portion;

a pressure rotary member for forming said nip portion with said heat rotary member therebetween;

contacting means for bringing said pressure rotary member into contact with said heat rotary member at a start of an image heating process; and changing means for changing a time from after said pressure rotary member has been brought into contact with said heat rotary member by said contacting means until the recording material arrives at said nip portion.

2. An image heating apparatus according to claim 1, further comprising detecting means for detecting a temperature of said pressure rotary member, wherein said changing means changes the time in accordance with the detected temperature of said pressure rotary member.

3. An image heating apparatus according to claim 2, wherein the time is longer when the detected temperature of said pressure rotary member is low than when the detected temperature of said pressure rotary member is high.

4. An image heating apparatus according to claim 1, wherein the time is longer when a time elapsed after a preceding recording material has passed through said nip portion is short than when a time elapsed after a proceeding recording material has passed through said nip portion is long.

5. An image heating apparatus according to claim 1, wherein said changing means changes the time so that said pressure rotary member may rise in temperature to a predetermined temperature range by a time the recording material arrives at said nip portion.

6. An image heating apparatus according to claim 5, wherein said changing means changes the time so that the temperature of said pressure rotary member at a point of time whereat the recording material has arrived at said nip portion may become lower than the temperature of said heat rotary member.

7. An image heating apparatus according to claim 1, further comprising:

a heater for heating said heat rotary member;

detecting means for detecting a temperature of said heat rotary member; and controlling means for controlling an electrical energization of said heater in accordance with the detected temperature of said heat rotary member.

8. An image heating apparatus according to claim 1, further comprising a heater for heating said pressure rotary member when said pressure rotary member is spaced apart from said heat rotary member.

9. An image heating apparatus according to claim 1, wherein said pressure rotary member is an endless belt.

10. An image heating apparatus according to claim 1, wherein said image heating apparatus fixes the image on the recording material.

11. An image heating apparatus comprising:

a heat rotary member for heating an image formed on a recording material in a nip portion;

a pressure rotary member for forming said nip portion with said heat rotary member therebetween; and contacting means for bringing said pressure rotary member into contact with said heat rotary member at a start of an image heating process;

detecting means for detecting a temperature of said pressure rotary member; and controlling means for variably controlling a time from after said pressure rotary member has been brought into contact with said heat rotary member by said contacting means until the recording material arrives at said nip portion in accordance with the detected temperature of said pressure rotary member.

12. An image heating apparatus according to claim 11, wherein said controlling means controls a contacting operation of said contacting means so that the time is longer when the detected temperature of said pressure rotary member is low than when the detected temperature of said pressure rotary member is high.

* * * * *

UNITED STATES PATENT AND TRADEMARK OFFICE

CERTIFICATE OF CORRECTION

PATENT NO. : 7,327,967 B2
APPLICATION NO. : 11/245245
DATED : February 5, 2008
INVENTOR(S) : Akihito Mori et al.

It is certified that error appears in the above-identified patent and that said Letters Patent is hereby corrected as shown below:

COLUMN 2
Line 1, “thus has” should be deleted.
Line 2, “time been” should read --time there has been--.

COLUMN 3
Line 37, “11a-1d.” should read --11a-11d.--.

COLUMN 5
Line 48, “(misregister)” should be deleted.

COLUMN 8
Line 40, “a” should be deleted.

COLUMN 15
Lines 51-56 (claim 4) should be deleted.

Signed and Sealed this

Seventeenth Day of February, 2009

JOHN DOLL
*Acting Director of the United States Patent and Trademark Office*